US005733202A

United States Patent [19]

Vargo

[11] Patent Number: 5,733,202

[45] Date of Patent: Mar. 31, 1998

[54] LASER PUTT TRAINING AID

[76] Inventor: Edward R. Vargo, 2947 Deerbrock St., Pomona, Calif. 91767

[21] Appl. No.: 846,172

[22] Filed: Apr. 28, 1997

[51] Int. Cl.[6] ..... A63B 69/36

[52] U.S. Cl. ..... 473/220; 473/221

[58] Field of Search ..... 362/205, 102, 362/118, 206; 473/220, 221

[56] References Cited

U.S. PATENT DOCUMENTS

| | | | |
|---|---|---|---|
| 3,004,140 | 10/1961 | Gomes | 362/118 |
| 3,677,553 | 7/1972 | Moore | 473/220 |
| 4,911,450 | 3/1990 | Rabold | 473/220 |
| 4,971,327 | 11/1990 | Rabold | 473/220 |
| 5,169,150 | 12/1992 | Tindale | 473/220 |
| 5,374,063 | 12/1994 | Ogden | 473/220 |
| 5,400,227 | 3/1995 | Maglica et al. | 362/206 |
| 5,401,030 | 3/1995 | Halliburton | 473/220 |
| 5,492,329 | 2/1996 | Kronin | 473/220 |

FOREIGN PATENT DOCUMENTS

| | | | |
|---|---|---|---|
| 000499569 | 8/1992 | European Pat. Off. | 273/186.3 |
| 406165845 | 6/1994 | Japan | 273/186.3 |
| 2039749 | 8/1980 | United Kingdom | 273/186.3 |

*Primary Examiner*—Sebastiano Passaniti

[57] ABSTRACT

A laser putt training aid including a shaft having a hollow configuration with a top end and a bottom end. Also included is a plurality of batteries situated within the shaft. A head is coupled to the bottom end of the shaft and has a flat hitting front surface, a rear surface, a top surface, and a bottom surface. The head has a bore formed therein between the front surface and the rear surface of the head. The head further has a lens coupled in the bore adjacent the front surface thereof with the lens being flush with the front surface. The head further includes a laser adapted to emit a laser through the bore upon the application of electric power thereto. Next provided is a cap switch having a first orientation for providing electrical communication between the batteries and the laser and a second orientation for precluding electrical communication therebetween.

4 Claims, 2 Drawing Sheets

LASER PUTT TRAINING AID

BACKGROUND OF THE INVENTION

1. Field of the Invention

The present invention relates to a laser putt training aid and more particularly pertains to improving a player's putting ability with a laser situated within a golf club head.

2. Description of the Prior Art

The use of putting aids is known in the prior art. More specifically, putting aids heretofore devised and utilized for the purpose of improving one's putting ability are known to consist basically of familiar, expected and obvious structural configurations, notwithstanding the myriad of designs encompassed by the crowded prior art which have been developed for the fulfillment of countless objectives and requirements.

By way of example, the prior art includes U.S. Pat. No. 5,388,832 to Hsu; U.S. Pat. No. 5,452,897 to Mick; U.S. Pat. No. 5,213,331 to Avanzini; U.S. Pat. No. 5,165,691 to Cook; U.S. Pat. No. 5,169,150 to Tindale; and U.S. Pat. No. 5,435,562 to Stock et al.

In this respect, the laser putt training aid according to the present invention substantially departs from the conventional concepts and designs of the prior art, and in so doing provides an apparatus primarily developed for the purpose of improving a player's putting ability with a laser situated within a golf club head.

Therefore, it can be appreciated that there exists a continuing need for a new and improved laser putt training aid which can be used for improving a player's putting ability with a laser situated within a golf club head. In this regard, the present invention substantially fulfills this need.

SUMMARY OF THE INVENTION

In view of the foregoing disadvantages inherent in the known types of putting aids now present in the prior art, the present invention provides an improved laser putt training aid. As such, the general purpose of the present invention, which will be described subsequently in greater detail, is to provide a new and improved laser putt training aid which has all the advantages of the prior art and none of the disadvantages.

To attain this, the present invention essentially comprises a conductive shaft having a hollow configuration with a top end and a bottom end. The shaft has a plurality of threads formed in an inner periphery of the top end thereof. As shown in FIG. 2, further provided is an elastomeric battery compartment having a tubular configuration. The battery compartment is situated within the shaft adjacent the top end thereof. The compartment has a closed bottom and an open top for allowing the insertion of batteries through the top end of the compartment for storage therein. An elastomeric grip is situated about an outer surface of the shaft adjacent the top end thereof. Next provided is a cap switch with a cylindrical configuration having a conductive housing. The housing includes a top extent with a knurled outer surface and a bottom extent with coaxial threads formed therein. Note FIG. 2. The cap switch further includes a V-shaped contact with a first end coupled to a bottom surface of the housing and extending downwardly therefrom. It is imperative that an insulative washer be positioned between the contact and the housing of the switch. A second end of the contact abuts a first terminal of the batteries. The cap switch further includes a push button switch positioned on a top surface of the housing thereof. Such push button switch is depressible along an axis of the shaft. In use, the push button of the cap switch has a first orientation effected upon the depression thereof for providing electrical communication between the housing of the cap switch and the V-shaped contact. The push button of the cap switch also has a second orientation effected upon the subsequent depression thereof for precluding electrical communication between the housing of the cap switch and the V-shaped contact. By this structure, the housing of the cap switch may be screwably coupled to the threads of the top end of the shaft in electrical communication therewith. With reference now to FIGS. 3 & 4, a conductive head is integrally coupled to the bottom end of the shaft. The head has a flat hitting front surface, a rear surface, a top surface, and a bottom surface. A bore is formed therein between the front surface and the rear surface of the head. The bore has a reduced diameter adjacent the front surface of the head and a plurality of threads formed therein adjacent the rear surface of the head. The head further has a lens coupled in the bore adjacent the front surface thereof with the lens being flush with the front surface of the head. The bore further has a cap screwably coupled to the threads of the bore for allowing selective entry to an interior of the bore. The head further includes a cylindrical laser situated within the bore with a first contact encompassing an entire outer periphery thereof in electrical communication with the head. A second contact is situated on a rear face of the laser. In operation, the laser is adapted to emit a laser through the lens upon the application of electric power to the contacts thereof. Finally, an insulated wire is connected between a second terminal of the batteries and the second contact of the laser. Upon the push button switch of the cap switch being in first orientation thereof and the cap switch being screwably coupled to the shaft, electric power is transmitted to the laser via the wire and shaft and head for directing a laser outwardly and perpendicularly from the front surface of the head. Such laser may be employed for improving a player's putt.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved laser putt training aid which has all the advantages of the prior art putting aids and none of the disadvantages.

It is another object of the present invention to provide a new and improved laser putt training aid which may be easily and efficiently manufactured and marketed.

It is a further object of the present invention to provide a new and improved laser putt training aid which is of a durable and reliable construction.

An even further object of the present invention is to provide a new and improved laser putt training aid which is susceptible of a low cost of manufacture with regard to both materials and labor, and which accordingly is then susceptible of low prices of sale to the consuming public, thereby making such laser putt training aid economically available to the buying public.

Still yet another object of the present invention is to provide a new and improved laser putt training aid which provides in the apparatuses and methods of the prior art some of the advantages thereof, while simultaneously overcoming some of the disadvantages normally associated therewith.

Still another object of the present invention is to improve a player's putting ability with a laser situated within a golf club head.

Lastly, it is an object of the present invention to provide a new and improved laser putt training aid including a shaft having a hollow configuration with a top end and a bottom end. Also included is a plurality of batteries situated within the shaft. A head is coupled to the bottom end of the shaft and has a flat hitting front surface, a rear surface, a top surface, and a bottom surface. The head has a bore formed therein between the front surface and the rear surface of the head. The head further has a lens coupled in the bore adjacent the front surface thereof with the lens being flush with the front surface. The head further includes a laser adapted to emit a laser through the bore upon the application of electric power thereto. Next provided is a cap switch having a first orientation for providing electrical communication between the batteries and the laser and a second orientation for precluding electrical communication therebetween.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

Similar reference characters refer to similar parts throughout the several views of the drawings.

DESCRIPTION OF THE PREFERRED EMBODIMENT

Figure 1:
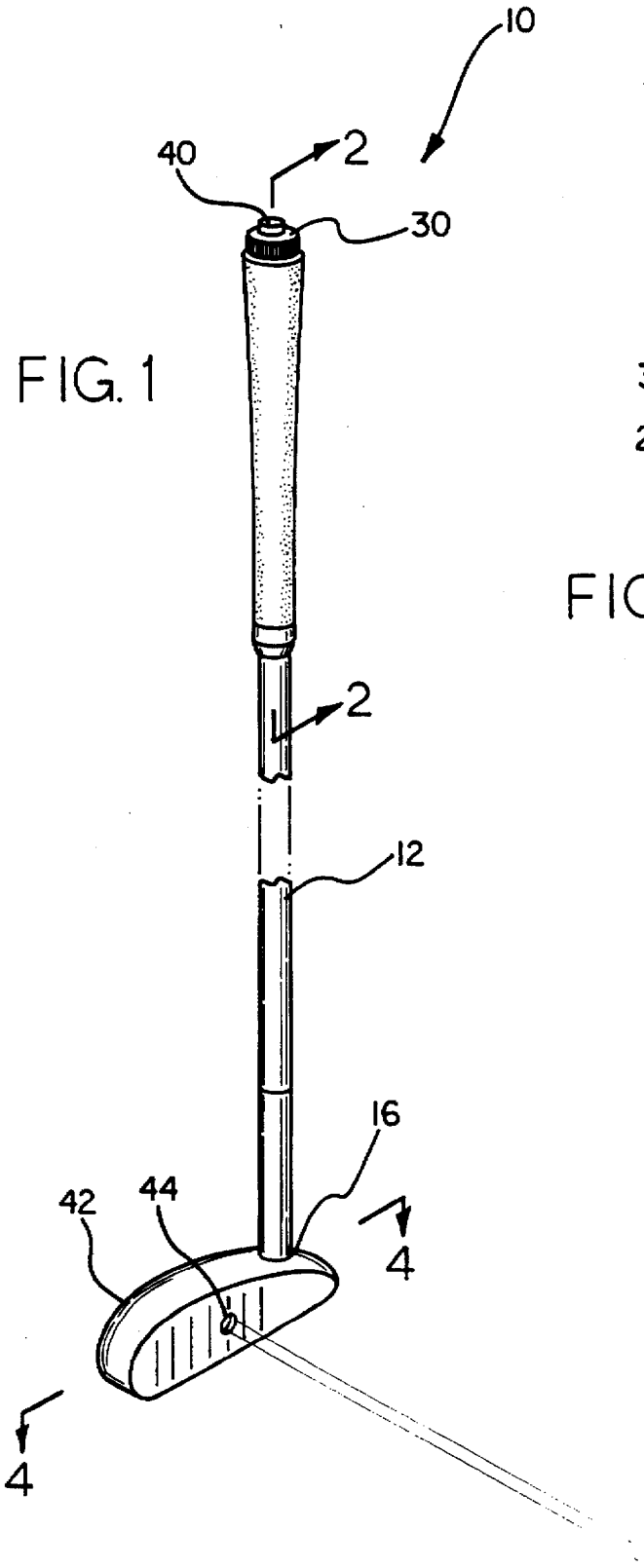
FIG. 1 is a perspective illustration of the preferred embodiment of the laser putt training aid constructed in accordance with the principles of the present invention.

With reference now to the drawings, and in particular to FIG. 1 thereof, a new and improved laser putt training aid embodying the principles and concepts of the present invention and generally designated by the reference numeral 10 will be described.

The present invention, the new and improved laser putt training aid, is comprised of a plurality of components. Such components in their broadest context include a shaft, a cap switch, a golf club head, and an insulated wire. Such components are individually configured and correlated with respect to each other so as to attain the desired objective.

Figure 2:
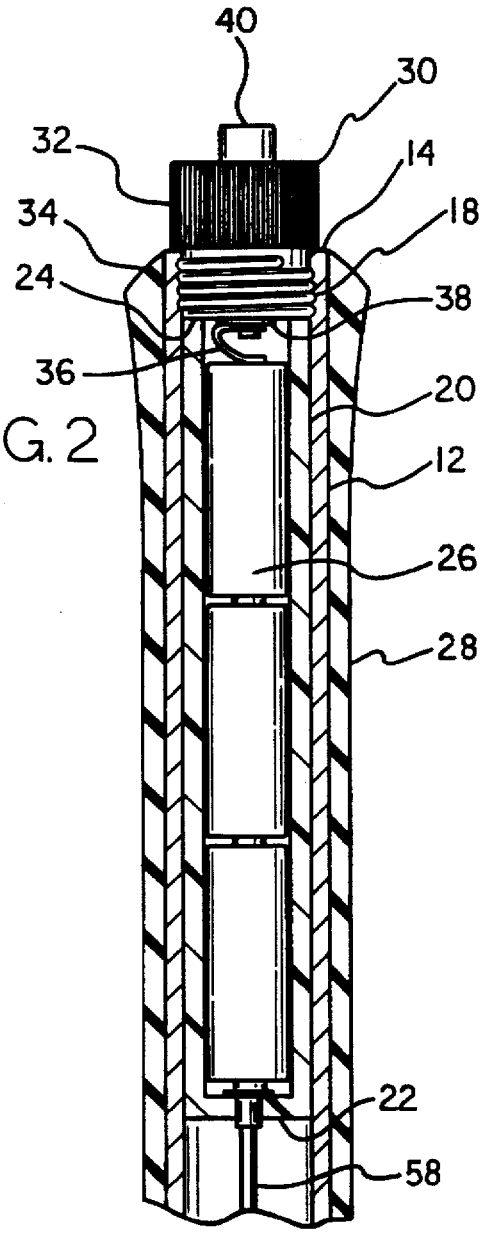
FIG. 2 is a cross-sectional view of the shaft and a side view of the cap switch.

More specifically, it will be noted that the system 10 of the present invention includes a conductive shaft 12 having a hollow configuration with a top end 14 and a bottom end 16. The shaft has a plurality of threads 18 formed in an inner periphery of the top end thereof. As shown in FIG. 2, further provided is an elastomeric battery compartment 20 having a tubular configuration. The battery compartment is situated within the shaft adjacent the top end thereof. The compartment has a closed bottom 22 and an open top 24 for allowing the insertion of batteries 26 through the top end of the compartment for storage therein. An elastomeric grip 28 is situated about an outer surface of the shaft adjacent the top end thereof. The grip has a constant diameter with the exception of a top end thereof whereat the grip is tapered outwardly to define a larger diameter.

Next provided is a cap switch 30 with a cylindrical configuration having a conductive housing. The housing includes a top extent 32 with a knurled outer surface and a bottom extent 34 with coaxial threads formed therein. Note FIG. 2. The cap switch further includes a V-shaped contact 36 with a first end coupled to a bottom surface of the housing and extended downwardly therefrom. It is imperative that an insulative washer 38 be positioned between the contact and the housing of the switch. A second end of the contact abuts a first terminal of the batteries. The cap switch further includes a push button switch 40 positioned on a top surface of the housing thereof. Such push button switch is depressible along an axis of the shaft. In use, the push button switch of the cap switch has a first orientation effected upon the depression thereof for providing electrical communication between the housing of the cap switch and the V-shaped contact. The push button of the cap switch also has a second orientation effected upon the subsequent depression thereof for precluding electrical communication between the housing of the cap switch and the V-shaped contact. During use of the present invention, the housing of the cap switch may be screwably coupled to the threads of the top end of the shaft in electrical communication therewith.

Figure 3:
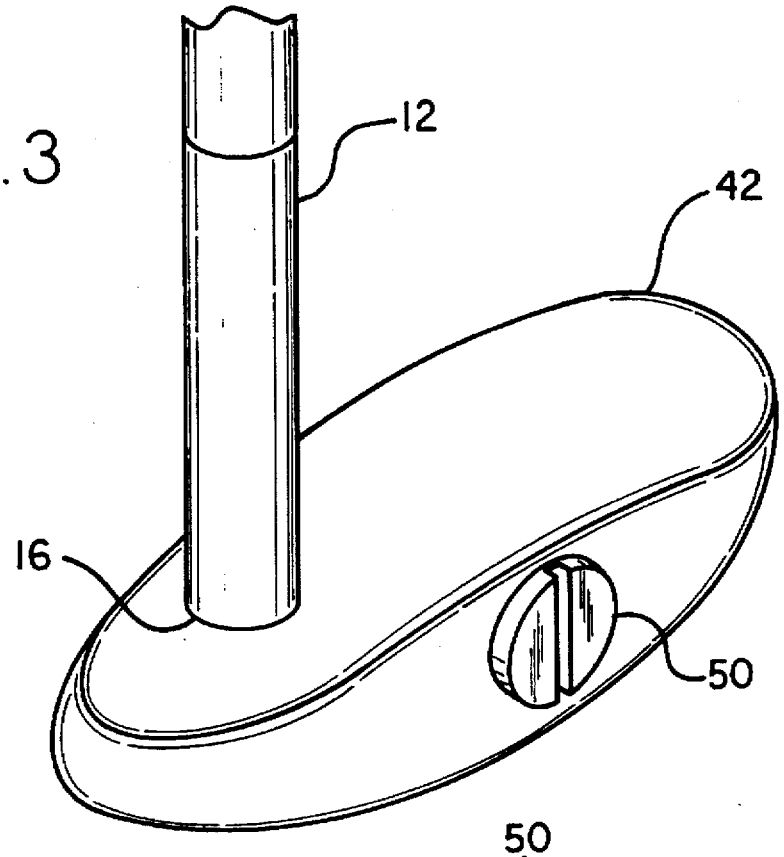
FIG. 3 is a perspective view of the head of the golf club of the present invention.
Figure 4:
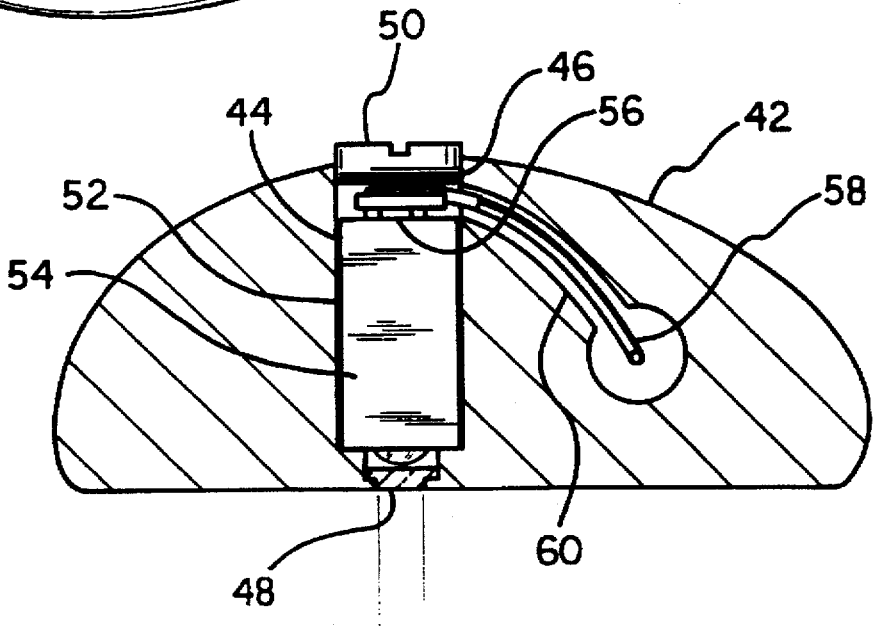
FIG. 4 is a cross-sectional view of the head of the golf club of the present invention.

With reference now to FIGS. 3 & 4, a conductive head 42 is integrally coupled to the bottom end of the shaft. The head has a flat hitting front surface, a rear surface, a top surface, and a bottom surface. A bore 44 is formed therein between the front surface and the rear surface of the head. The bore has a reduced diameter adjacent the front surface of the head and a plurality of threads 46 formed therein adjacent the rear surface. The head further has a lens 48 coupled in the bore adjacent the front surface thereof with the lens being flush with the front surface of the head. The bore further has a cap 50 screwably coupled to the threads of the bore for allowing selective entry to an interior of the bore. The cap has a linear groove formed therein for allowing the removal thereof with a standard screwdriver. The head further includes a cylindrical laser 52 situated within the bore with a first contact 54 encompassing an entire outer periphery thereof in electrical communication with the head. As such, the shaft and head become a conductor which links the laser and push button via the conductive shaft and head. A second contact 56 is situated on a rear face of the laser. In operation, the laser is adapted to emit a laser through the lens upon the application of electric power to the contacts.

Finally, an insulated wire 58 is connected between a second terminal of the batteries and the second contact of the laser. Within the head, the wire is preferably positioned within a channel 60 that extends between the bore of the head and the hollow shaft. Upon the push button switch of the cap switch being in first orientation thereof and the cap switch being screwably coupled to the shaft, electric power is transmitted to the laser via the wire and the shaft and head for directing a laser outwardly and perpendicularly from the front surface of the head. Such laser may be employed for improving a player's putt.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A new and improved laser putt training aid comprising, in combination:

a conductive shaft having a hollow configuration with a top end and a bottom end, the shaft having a plurality of threads formed in an inner periphery of the top end thereof, an elastomeric battery compartment having a tubular configuration and situated within the shaft adjacent the top end thereof with the compartment having a closed bottom and an open top for allowing the insertion of batteries through the top end of the compartment for storage therein, and an elastomeric grip situated about an outer surface of the shaft adjacent the top end thereof;

a cap switch with a cylindrical configuration having a conductive housing including a top extent with a knurled outer surface and a bottom extent with coaxial threads formed therein, the cap switch further including a V-shaped contact with a first end coupled to a bottom surface of the housing and extending downwardly therefrom wherein a insulative washer is positioned between the contact and the housing of the switch and a second end of the contact abuts a first terminal of the batteries, the cap switch further including a push button switch positioned on a top surface of the housing of the cap switch which is depressible along an axis of the shaft, the cap switch having a first orientation effected upon the depression thereof for providing electrical communication between the housing of the cap switch and the V-shaped contact and a second orientation effected upon the subsequent depression thereof for precluding electrical communication between the housing of the cap switch and the V-shaped contact, whereby the housing of the cap switch may be screwably coupled to the threads of the top end of the shaft in electrical communication therewith;

a conductive head integrally coupled to the bottom end of the shaft and having a flat hitting front surface, a rear surface, a top surface, and a bottom surface, the head having a bore formed therein between the front surface and the rear surface of the head, the bore having reduced diameter adjacent the front surface of the head and a plurality of threads formed therein adjacent the rear surface of the head, the head further having a lens coupled in the bore adjacent the front surface thereof with the lens being flush with the front surface of the head, the bore further having a cap screwably coupled to the threads of the bore for allowing selective entry to an interior of the bore, the head further including a cylindrical laser situated within the bore with a first contact encompassing an entire outer periphery thereof in electrical communication with the head and a second contact situated on a rear face thereof, the laser adapted to emit a laser through the lens upon the application of electric power to the contacts thereof; and an insulated wire connected between a second terminal of the batteries and the second contact of the laser, whereby upon the push button switch of the cap switch being in first orientation thereof and further screwably coupled to the shaft, electric power is transmitted to the laser via the wire and shaft and head for directing a laser outwardly and perpendicularly from the front surface of the head.

2. A laser putt training aid comprising:

a shaft having a top end and a bottom end;

a head coupled to the bottom end of the shaft and having a flat hitting front surface, a rear surface, a top surface, and a bottom surface, the head further including a laser adapted to emit a laser upon the application of electric power thereto via a plurality of batteries; and a cap switch having a conductive housing including a top extent with a knurled outer surface and a bottom extent with coaxial threads formed therein, the cap switch further including a V-shaped contact with a first end coupled to a bottom surface of the housing and extending downwardly therefrom wherein an insulative washer is positioned between the contact and the housing of the switch and a second end of the contact abuts a first terminal of the batteries, the cap switch further including a push button switch positioned on a top surface of the housing of the cap switch which is depressible along an axis of the shaft, the cap switch having a first orientation effected upon the depression thereof for providing electrical communication between the housing of the cap switch and the V-shaped contact and a second orientation effected upon the subsequent depression thereof for precluding electrical communication between the housing of the cap switch and the V-shaped contact, whereby the housing of the cap switch may be screwably coupled to threads of the top end of the shaft.

3. A laser putt training aid as set forth in claim 2 wherein the laser is situated within the head and emits a laser out of a bore formed therein.

4. A laser putt training aid as set forth in claim 2 wherein the shaft is equipped with a grip situated thereon adjacent the top end thereof.

* * * * *